US005546662A

United States Patent [19]

Seber et al.

[11] Patent Number: 5,546,662

[45] Date of Patent: Aug. 20, 1996

[54] KNIFE WITH LOCKABLE BLADE

[75] Inventors: Brett P. Seber, Escondido; Roy L. Helton, Jr., San Diego, both of Calif.

[73] Assignee: Buck Knives, Inc., El Cajon, Calif.

[21] Appl. No.: 307,183

[22] Filed: Sep. 16, 1994

Related U.S. Application Data

[63] Continuation-in-part of Ser. No. 138,703, Oct. 18, 1993, abandoned, and a continuation-in-part of Ser. No. 138,670, Oct. 18, 1993, abandoned.

[51] Int. Cl.[6] ..... B26B 1/04

[52] U.S. Cl. ..... 30/161; 30/160

[58] Field of Search ..... 30/160, 161, 340, 30/331, 330; 7/118–120

[56] References Cited

U.S. PATENT DOCUMENTS

| | | | |
|---|---|---|---|
| 1,862,649 | 6/1932 | Amoroso | 30/155 |
| 3,754,319 | 8/1973 | Miori | 30/340 |
| 4,896,424 | 1/1990 | Walker | 30/161 |
| 4,985,998 | 1/1991 | Howard | 30/160 |

*Primary Examiner*—Douglas D. Watts
*Attorney, Agent, or Firm*—Gregory Garmong

[57] ABSTRACT

The blade of a folding knife is pivoted on a D-shaped pivot axle which also serves to lock the side pieces and belt clip of the knife in place. A thumb pin used to open the blade is also D-shaped and press fit into place in the blade. The blade has transverse grooves at its base to aid in extracting the knife from a sheath. The blade is locked into place by a side-lock plate, which is held in place by ridges in the side pieces. The side pieces are preferably made of rigid plastic, but with soft inserts in the sides for improved gripping.

8 Claims, 3 Drawing Sheets

FIG. 2
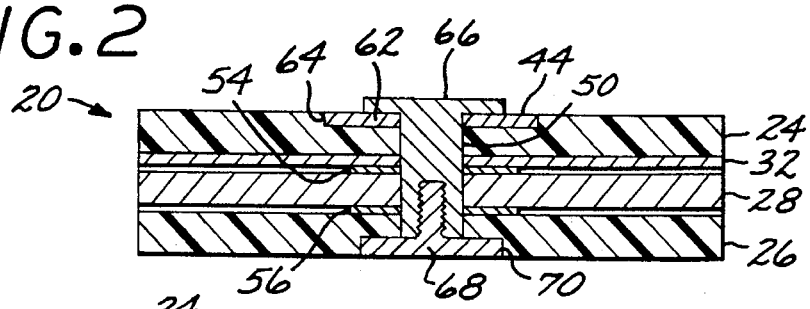
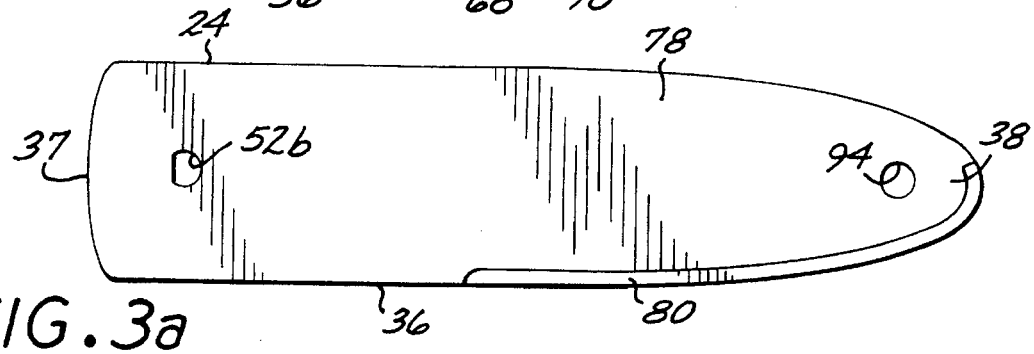
FIG. 3a
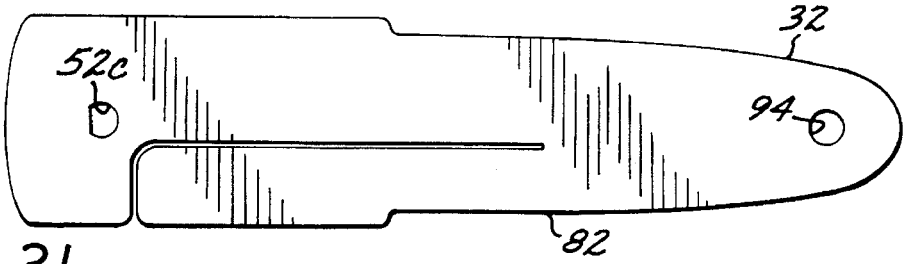
FIG. 3b
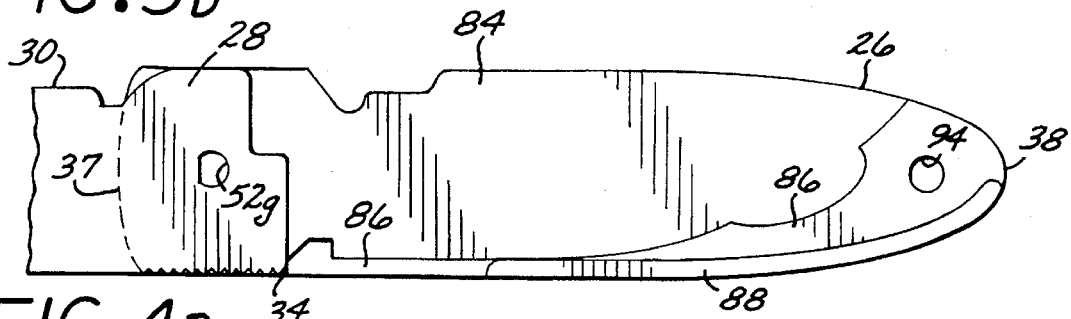
FIG. 4a
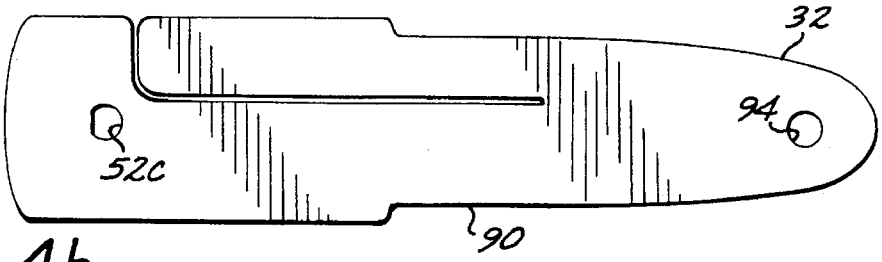
FIG. 4b

KNIFE WITH LOCKABLE BLADE

This application is a continuation-in-part of application Ser. No. 08/138,703, filed Oct. 18, 1993, now abandoned for which priority is claimed; and is also a continuation-in-part of application Ser. No. 08/138,670, now abandoned filed Oct. 18, 1993, for which priority is claimed. The disclosures of these applications are incorporated by reference.

This invention relates to knives, and, more particularly, to an improved movable blade knife.

Knives are commonly available with either fixed blades or extendable blades. The fixed blade knife, whose blade is permanently fixed in the extended position, is popular with outdoorsmen because it is strong and can be provided with features particularly useful in hunting, fishing, and other outdoor activities. The extendable blade knife, on the other hand, can be provided with multiple blades and many more features than the fixed blade knife. The extendable blade knife is also more compact than the fixed blade knife for carrying and storage. The most popular type of extendable blade knife is the folding blade knife, and the present invention is preferably used in conjunction with such folding blade knives.

The folding blade knife has a knife body and at least one pivot axle. The blade or blades are pivotably mounted to the pivot axle or pivot axles. The knife has a detent mechanism to hold the blades in the closed position within the knife body, until the user of the knife selects one of the blades for use. The selected blade is controllably extended by rotating it about its pivot pin to the open position. An aid to opening the blade, such as a thumb groove on the blade, is often present.

A detent mechanism may be provided to retain the blade in the closed position so that it does not partially open in an uncontrollable manner. The detent mechanism usually includes a biasing structure that urges the blade toward the closed position but can be overcome by mild pressure when the blade is to be opened. A locking mechanism may be provided to lock the selected blade in the open position in a manner that permits later selective unlocking of the blade and pivoting it back to the closed position. Alternatively, there may be provided no locking mechanism for the extended blade, so that the user holds the blade in position during use.

A number of detent and locking mechanisms are available for use with folding knives. In one approach, the mechanism includes a spring bearing on the blade to create an overcenter arrangement which retains the blade in the closed position until forced open against the spring force by the user. The spring mechanism creates a force that tends to return the blade to the closed position once the overcenter position is reached. There may be a positive lock of the blade in the extended position, such as in the well known lockback configuration. In another approach, a ball detent structure holds the blade in the closed position, and a lock is provided to lock the blade in the open position. In this case, there is no spring force tending to close the blade.

In yet another approach, a side lock plate is placed laterally adjacent to the blade to be locked. The side lock plate includes a finger that is biased toward the blade to be locked. The blade is normally held closed by a detent mechanism. When the blade is opened, the finger locks the blade in the open position. The user later selectively unlocks the blade so that it can be folded closed by depressing the finger and disengaging it from the blade.

Although all of these mechanisms and approaches can be made operable, there is an ongoing need for structures for folding knives that are convenient to use, strong and reliable, relatively simple in mechanical arrangement, and relatively inexpensive to produce. Such structures can aid in retaining the blade in the closed position, grasping and opening the blade, and strengthening the knife structure. The present invention provides such an improved structure, and further provides related advantages.

SUMMARY OF THE INVENTION

The present invention provides a knife having a movable blade, preferably a folding blade, which has a detent structure, closing and opening mechanism, and convenience features that make it particularly suitable for general use. The knife is strong due to the arrangement and manner of interconnecting the structural components. The blade is held in the closed position by a detent mechanism that is quite smooth in operation and suitable for one-handed opening of the blade. Features on the blade make it easy to retrieve the knife from its stored position, firmly grasp the knife handle, and operate the blade with one hand.

In accordance with one aspect of the invention, a detent mechanism biases a blade toward its closed position as the blade completes its closure movement. Such a knife comprises a knife body, a first member fixed stationary with respect to the knife body, and a second member that is movable with respect to the knife body between a closed position wherein the first member and the second member are in a facing relationship and an open position wherein the first member and the second member are not in a facing relationship. There is a detent mechanism comprising a detent protrusion supported on one of the first member and the second member and extending a height above the member on which is supported, the detent protrusion having a detent protrusion surface profile thereon. A detent protrusion recess is present on the other of the first member and the second member, the recess being positioned to receive the detent protrusion therein when the second member is in the closed position. The recess has a recess surface profile which matches to the protrusion surface profile which matches to the protrusion surface profile over at least a respective portion of the profiles.

The knife can also be provided with a pivoting axle for the blade that is cylindrical but with a keying structure that aids in engaging the side pieces of the knife handle and a belt clip together. This knife comprises a knife body having a first side piece and a second side piece, with the second side piece being parallel to and separated from the first side piece. The first side piece and the second side piece have aligned pivot axle bores therethrough. A cylindrical pivot axle extends through the pivot axle bores, and a blade is pivotably supported on the pivot axle. A clip having an engagement region is fastened to one of the side pieces. There is keying means for engaging the clip to the first side piece and for preventing the clip from rotating with respect to the first side piece. The keying means includes a key on the pivot axle, and a keyway on the clip engagement region.

A thumb pin is present in some embodiments to aid in opening the blade from its closed position. This knife comprises a handle and a blade movably attached to the handle and having a noncircular thumb pin receiver opening therethrough. A thumb pin has a cross sectional shape along a first portion of its length matching to the cross sectional shape of the thumb pin receiver, which first portion is roughened, preferably by knurling, and is press fit into the thumb pin receiver opening.

An aid for grasping and extracting the knife from its stored position, on a belt clip or in a pouch, can be used. A knife of this type comprises a handle, and a blade pivotably attached to the handle and having a long axis. The blade has a blade root portion with a top side and a bottom side. A first plurality of grooves are formed in the top side of the blade root portion, with the grooves extending perpendicular to the long axis of the blade. A second plurality of grooves is formed in the bottom side of the blade root portion, with the grooves extending perpendicular to the long axis of the blade.

As a further aid in grasping the knife, the knife body may be made of a rigid material with flexible inserts in the side pieces. This knife comprises a blade and a handle to which the blade is attached. The handle includes a first side piece and a second side piece lying parallel to, and spaced apart from, the first side piece to receive the blade therebetween. Each of the first and the second side pieces comprises a rigid plastic frame having an opening therethrough, and a flexible insert fixed within the opening. The insert is preferably made of an elastomer that is fixed in place by a sonic weldment.

In one particularly preferred embodiment, the knife has a side lock mechanism for releasably locking the blade in the open position. Side lock mechanisms are known, but in some cases the knives using such a locking approach lack structural strength in the handle, particularly where the side pieces of the handle are made of a nonmetallic material such as a plastic. A knife having an improved side locking mechanism includes a blade having a top side and a bottom side, a first side piece, and a second side piece lying parallel to, and spaced apart from, the first side piece. The side pieces each have a top side and a bottom side that respectively lie adjacent to the top side and the bottom side of the blade when the blade is in an open position. A pivot axle extends between the first side piece and the second side piece at a first end of the knife. The blade is supported on the pivot axle so that the blade may pivot from the open position to a closed position. A locking plate lies parallel to and between the first side piece and the second side piece. The locking plate is positioned between the first side piece and the blade when the blade is in the closed position. The locking plate has a first end adjacent to the pivot axle and a second end remote from the pivot axle. The first side piece has a raised first rim along the bottom side of the side piece adjacent to the second end of the locking plate. The second side piece has a raised second rim along the top side of the side piece adjacent to the second end of the locking plate. The first rim and the second rim capture the second end of the locking plate therebetween and hold it firmly in place. The metal locking plate thereby becomes a structural component that strengthens and adds rigidity to the knife handle, as well as serving its usual role as a locking mechanism for the blade.

The knife as described herein thus utilizes a basic structure of an extendable blade knife that is well established and familiar to users of such knives. Improvements aid in retaining the blade in the closed position, retrieving the knife, opening the blade, and holding the knife. The components of the knife are fastened together in a reliable, rigid structure. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 2 is a sectional view through the region of the blade axle of the knife of FIG. 1, along line 2—2 of FIG. 1, but after assembly of the knife components;

FIG. 3*a* is an elevational view of the interior side of the first side piece;

FIG. 3*b* is an elevational view of the locking plate as it is oriented with respect to the first side piece as shown in FIG. 3*a;*

FIG. 4*a* is an elevational view of the interior side of the second side piece;

FIG. 4*b* is an elevational view of the locking place as it is oriented with respect to the first side piece as shown in FIG. 4*a;*

DETAILED DESCRIPTION OF THE INVENTION

Figure 1:
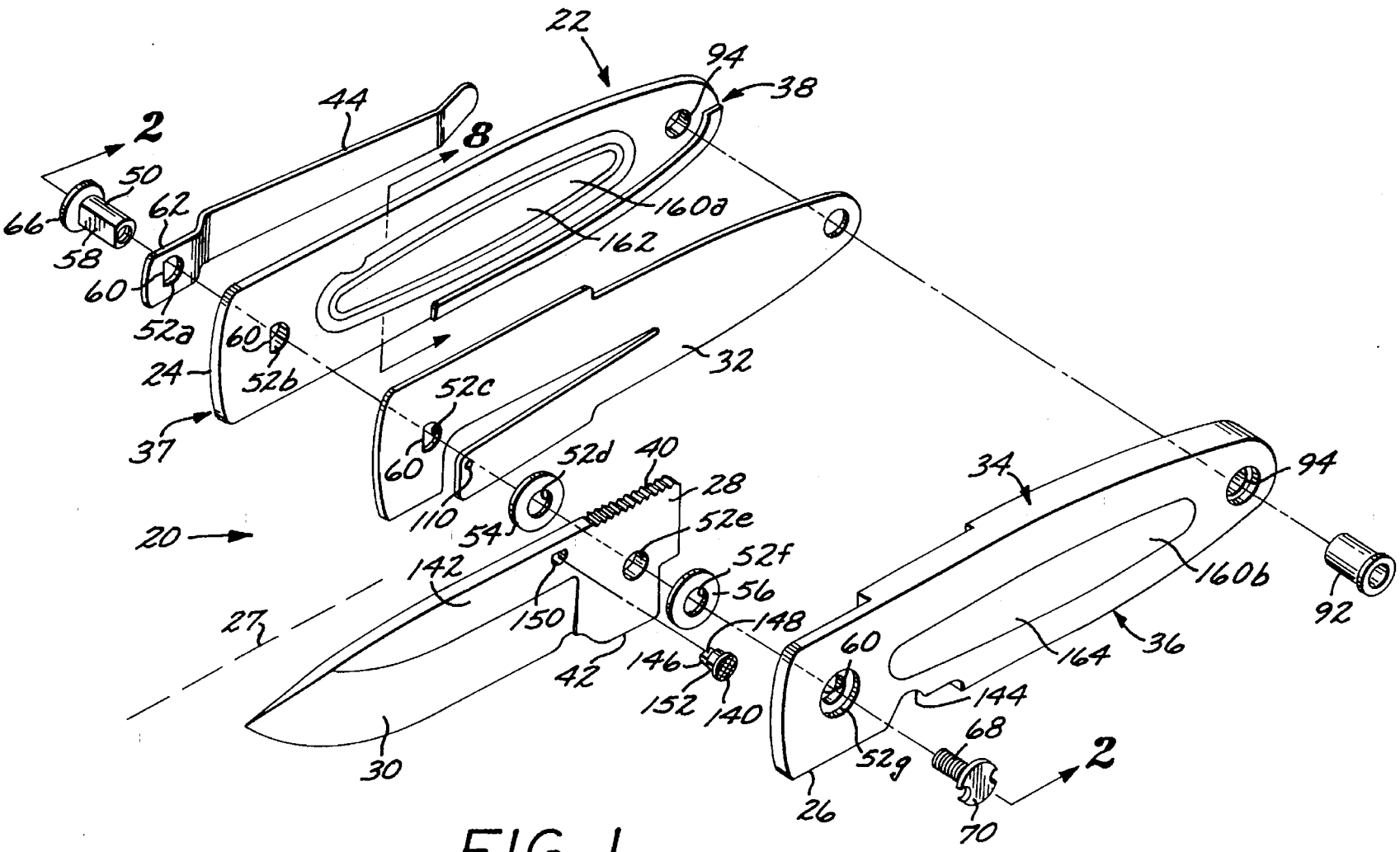
FIG. 1 is an exploded perspective view of a knife according to the invention.

FIG. 1 depicts a knife 20 according to the invention, in exploded perspective view to illustrate the structure and assembly of the components of the knife. The knife 20 will first be described in general terms, with the specific features discussed subsequently.

The knife 20 includes a knife body 22, which serves as a handle when the blade is opened. The knife body 22 includes a first side piece 24 and a second side piece 26. The side pieces 24 and 26 are elongated along a knife axis 27 to fit comfortably in the hand of a user. A root portion 28 of a blade 30 and a locking plate 32 are disposed between the two side pieces 24 and 26, with the locking plate 32 positioned between the blade 30 and the first side piece 24 in the illustrated embodiment.

The knife 20, its component side pieces 24 and 26, the blade 30, and the locking plate 32 may be described as having a top side 34 and a bottom side 36. The top and bottom sides of the movable blade 30 are defined in reference to its orientation in the illustrated open blade position. The knife 20, its component side pieces 24 and 26 and, the locking plate 32 may be further described as having a front end 37 from which the blade 30 projects when open, and a back end 38 at the opposite end of the knife. The top side, bottom side, front end, and back end of the knife are defined for reference in describing the interrelation of the components and features of the knife.

The knife 20 is of the preferred side lock type, in which the blade 30 is locked in its open position by the locking plate 32 in a manner to be described. However, the features of the present knife not related directly to the locking plate may be used in conjunction with other types of extendable blade knives such as, for example, lock back folding knives.

A first plurality of grooves 40 are present on the top side 34 of the blade root portion 28. A second plurality of grooves 42 are present on the bottom side 36 of the blade root portion 28. The grooves 40 and 42 extend perpendicular to the long axis of the knife, the knife axis 27. These grooves 40 and 42 are used in grasping the knife 20 to retrieve it from a stored location. The knife 20 may be provided with a clip 44 for attachment to a belt, or it may have no clip and be used in conjunction with a storage pouch or stored in a pocket of the user. In any of these storage approaches, when the knife is to be used the user reaches to grasp the knife to retrieve it. Particularly when the knife is wet or tightly retained in the storage position, it may be difficult to grasp the knife to accomplish retrieval. The two sets of grooves 40 and 42 can be felt by the fingers of the user and firmly grasped. (During retrieval, the blade 30 is normally closed, but the presence of two sets of grooves 40 and 42 ensure that grooves will be accessible to the fingers on both the top side and the bottom side of the knife when the blade is closed.)

It has been known to provide a single set of grooves along the top side (also sometimes called the back) of the blade 30, but these grooves serve primarily to give leverage for the thumb of the user in cutting operations when the blade is open. The top side grooves 40 of the present knife 20 can be used in this manner. However, they also cooperate with the second set of grooves 42 for the retrieval function described above. This cooperation is absent when only a single set of grooves is used.

The blade 30 is pivotable between an open position, illustrated in FIG. 1, and a closed position in which the blade is folded into the knife body 22. The accomplish the pivoting action, the root portion 28 of the blade pivots about a pivot axle 50 positioned near the front end 37 of the knife body 22. The pivot axle 50 is generally cylindrical but with a key structure to be described. The generally cylindrical form allows the blade to rotate on the majority of the cylindrical surface of the pivot axle 50, but also provides a keying structure that aids in holding the knife components in a defined position.

The pivot axle 50 is oriented transverse to the knife axis 27. Referring to FIGS. 1 and 2, the pivot axle 50 extends through a pivoting bore 52 that is formed by aligning during assembly a pivoting bore opening 52*a* in the clip 44, a pivoting bore opening 52*b* in the first side piece 24, a pivoting bore opening 52*c* in the locking plate 32, a pivoting bore opening 52*d* in a first washer 54, a pivoting bore opening 52*e* in the root portion 28 of the blade 30, a pivoting bore opening 52*f* in a second washer 56, and a pivoting bore opening 52*g* in the second side piece 26. The pivoting bore opening 52*e* in the blade 30 is circular, so that the blade 30 can pivot on the cylindrical portion of the pivot axle 50. The pivoting bore openings 52*d* and 52*f* are also preferably circular, because there is no reason to prevent the turning of the washers 54 and 56 and because conventional washers are available with circular central openings.

The pivot axle 50 has a key 58 thereon. At least two of the pivoting bore openings 52*a*, 52*b*, 52*c*, and 52*g* have a keyway 60 in the opening which matches to the key 58. The terms "matches to", "matching to", or the like, as used here, mean that two components have surfaces that conform to each other when the components are placed into a facing relationship. For example, in the preferred approach, the key 58 is a flat surface on one side of the pivot axle, produced by machining a flat onto the cylinder. The keyway 60 is a matching flat surface on the interior of the opening. The pivot axle 50 can be inserted through the opening only by aligning the flat surface of the key with the flat surface of the keyway. Once the pivot axle 50 has been inserted into the opening, the pivot axle cannot be rotated with respect to the opening due to the engagement of the key with the keyway.

The engagement of the key on the pivot axle 50 with the keyways on the pivoting bore openings 52*a*, 52*b*, 52*c*, and/or 52*g* prevents the keyed elements from rotating with respect to each other, thereby serving to hold them in place in the assembled knife. In the preferred embodiment, all of the openings 52*a*, 52*b*, 52*c*, and 52*g* have keyways, so that the clip 44, the first side piece 24, the locking plate 32, and the second side piece 26 are locked together by the key 58 against rotational movement and also act together when cutting forces are applied to the knife body 22 by the user's hand during use of the knife 20. This engagement thus strengthens the knife body 22 so that its acts as a single unit, without the need for multiple additional fasteners at the front end 37 of the knife body 22.

By this approach, the clip 44 is engaged to the knife body 22 to resist rotational movement when the clip is placed over a belt or the like. Rotation of the clip 44 is also prevented by providing a noncircular, shaped engagement region 62 at the end of the clip nearest the front end 37 of the knife body 22, as shown in FIG. 2. A recess 64 in the exterior side of the first side piece 24 has a shape matched to that of the engagement region 62, so that the engagement region 62 is received into the recess 64.

The pivot axle 50 is preferably provided with a head 66 at one end. The opposite end is internally threaded. A pivot axle retainer screw 68 has a head 70 at one end and is externally threaded at the other end to threadably engage the internal threads in the pivot axle 50. As shown in FIG. 1, during assembly the pivot axle 50 is placed through the pivoting bore openings 52, and the pivot axle retainer screw 68 is engaged and tightened to hold the front end 37 of the knife together.

The locking plate 32 is engaged to the side pieces 24 and 26 by a geometric fit rather than a separate fastener, thereby minimizing the use of fasteners in the knife 20. FIGS. 3*a* 3*b* show the relation of the inside-facing surface of the first side piece 24 and the locking plate 32, and FIGS. 4*a* and 4*b* show the relation of the inside-facing surface of the second side piece 26 and the locking plate 32. The view of FIGS. 4*a* and 4*b* is rotated about the knife axis 27 of FIG. 1, as compared with the view of FIGS. 3*a* and 3*b*, for clarity.

Referring to FIG. 3*a* , the first side piece 24 is generally flat on its inside surface 78 but has a first rim 80 that is raised about 0.040 inch above an inside surface 78 of the first side piece 24. (All dimensions set forth herein are presented by way of example for a preferred version of the knife 20.) The first rim 80 extends from a point about midway down the bottom side 36 to the back end 38 of the first side piece 24, at the periphery of the first side piece 24, at the periphery of the first side piece 24. Referring to FIG. 3*b*, the locking plate 32 has a matching first cutout region 82. When the locking plate 32 is assembled with the first side piece 24, the locking plate rests against the inside surface 78 with the cutout 82 matched to and engaged to the first rim 80.

Referring to FIG. 4*a*, the second side piece 26 has a generally flat inside surface 84 with two distinct raised regions. A shelf 86 that is raised with respect to the flat surface 84 by about 0.040 inches extends over a portion of the interior of the second side piece 26 from just behind the root portion 28 of the blade to the back end 38 of the knife body 22. A second rim 88 is raised with respect to the shelf 86 by about 0.040 inches. The second rim 88 extends from a point about midway down the top side 34 to the back end 38 of the second side piece 26 (a distance of about 1.555 inches in a preferred version of the knife), at the periphery of the second side piece 26. The shelf 86 is adjacent to, but located more centrally than, the second rim 88. Referring to FIG. 4*b*, the locking plate 32 has a matching second cutout region 90 that is matched to the second rim 88.

In the assembly, as shown in FIG. 1, the second washer 56 (not shown in FIG. 4*a* or 4*b*) is placed adjacent to the inside surface 84, and the root portion 28 of the blade 30 is placed over the second washer 56. The locking plate 32 is positioned over the root portion 28 of the blade 30, with the back and top regions of the locking plate resting against the shelf 86. The inside surface 84 and adjacent periphery of the shelf 86 thereby form a pocket into which the blade 30 is folded when the blade is closed. The second cutout region 90 matches to and engages to the second rim 88. A fastener 92 is placed through a fastener bore 94 formed by aligned bores in the first side piece 24, the locking plate 32, and the second side piece 26 as shown in FIG. 1.

The cooperation of the keyed structure of the pivot axle 50, the fastener 92, and the matching engagement of the cutouts 82 and 90 of the locking plate 32 to the respective rims 80 and 88 imparts to the knife 20 high structural rigidity while using only the two fastening components 50 and 92 that extend through the thickness of the knife. In a preferred version of the knife 20, the side pieces 24 and 26 are formed of a relatively thin plastic. The side pieces 24 and 26 by themselves are not of sufficient structural rigidity for normal knife uses. The cooperative engagement of the locking plate 32 to the side pieces 24 and 26 increases the overall rigidity of the knife body 22 so that it is suitable for moderately heavy duty cutting.

When the blade 30 is rotated about the pivot axle 50 to the closed position within the knife body 22, it is desirable that there be a detect structure to hold the blade 30 in place. The detent structure draws the blade into its proper closed position over the last portion of the closing pivoting movement. The detent structure should be easily overcome by the user to rotate the blade 30 to the open position.

Figure 5:
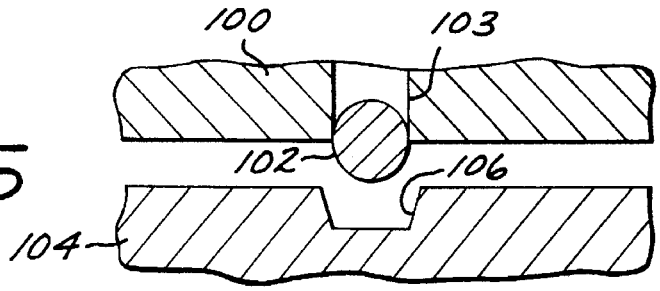
FIG. 5 is a sectional view of a conventional detent mechanism.

Ball-and-recess detent mechanisms are well known in the art, and FIG. 5 illustrates such a detent mechanism. One of the facing elements 100 has a semicircular protruding ball 102. The ball 102 is normally installed into the element 100 by drilling a bore 103 through the element 100. The bore 103 has a diameter slightly smaller than that of the ball 102, so that the ball 102 is force fit into the bore 103 during installation. The other of the facing elements 104 has a recess 106 into which the ball 102 is received. In FIG. 5, the elements 100 and 104 are separated slightly for illustrative purposes. In practice, the elements 100 and 104 are pressed tightly together. The ball 102 extends about 0.020 inches above the surface of the element 100, and the recess 106 is slightly more than 0.020 inches deep so that the ball 102 does not bottom out in the recess 106. As the elements are moved from the open position in which the ball 102 and recess 106 are not in facing relation to the closed position in which the ball 102 and the recess 106 are placed into facing relation as shown in FIG. 5, the ball 102 slides down the side of the recess 106, drawing the elements 100 and 104 into the final closed position. When the elements are to be moved back to the open position, the slightly resilient elements 100 and 104 are separated by manual force. The required separating force is the force that holds the elements in the closed position until opening is desired. While operable, such a conventional detent mechanism is relatively expensive to produce. The bore 103 and ball 102 must be precisely sized. The ball 102 must be precisely force fit into the bore 103, and this installation is often accomplished only with some difficulty. It is difficult to achieve good repeatability of the installation and of the detent mechanism.

Figure 6:
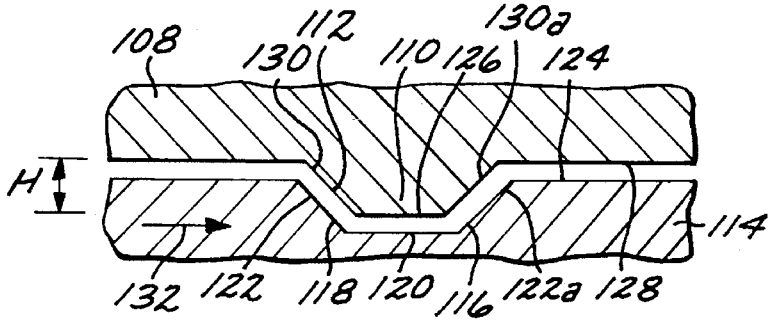
FIG. 6 is a sectional view of a detent mechanism according to the invention.

An improved detent mechanism according to the present approach is illustrated in FIG. 6. A first element 108, which in the present case is the locking plate 32, has a detent protrusion 110 thereon. The detent protrusion 110 has a detent protrusion surface profile 112. The detent protrusion 110 is preferably machined onto the first element 108 during manufacture. It is not typically prepared as a separate element that is thereafter attached to the first element 108, as in the case of the conventional ball-detent mechanism.

A second element 114, which in the present case is the root portion 28 of the blade 30, has a recess 116 therein. The recess 116 has a recess protrusion surface profile 118. In the preferred case, the recess surface profile 118 includes a flat bottom 120 parallel to a top surface 124 of the second element 114 and an inclined side surface 122, which is most preferably inclined at an angle of about 45 1 degrees to the flat bottom 120.

The detent protrusion surface profile 112 has a shape that is matched to the surface profile 118 of the recess 116, over at least a portion of their areas. In this case, the detent protrusion 110 has a flat elevated surface 126 parallel to a top surface 128 of the first element 198. The elevated surface 126 is raised above the top surface 128 by a height H of about 0.020 inches in the preferred embodiment. The recess 106 is slightly more than 0.020 inches deep, so that the elevated surface 126 of the detent protrusion 110 does not bottom out on the bottom of the recess 106 when the detent elements are engaged together. The detent protrusion 110 has an inclined side surface 130, which is most preferably inclined at an angle of about 45 degrees to the elevated surface 126.

The profiles 112 and 118 are illustrated in FIG. 6 as being matched over their entire areas, but this is not necessarily the case and is done in this manner for ease in machining the parts. The profiles need only be matched for the portions that are moved past each other during the closing and opening operations. For example, if the element 108 is held stationary and the element 114 is moved to the closed position by motion in the direction of the arrow 132, only the inclined sides **122*a* and 130*a*** that first encounter each other during the closing movement.

To aid in moving the blade 30 from the closed to the open position, a thumb pin 140 protrudes from a side 142 of the blade 30. When the blade is closed, the thumb pin 140 is received into a cutout 144 on the second side piece 26. The use of thumb pins for this purpose is known in the art. Such prior art thumb pins are engaged to the blade by a further component, a threaded fastener. The fastener protrudes on the opposite side of the blade from the thumb pin, requiring for the provision of space within the knife body for the protruding fastener when the blade is in the closed position and also adversely affecting the appearance of the knife. Additionally, the thumb pin can loosen with time and use in service.

Figure 7:
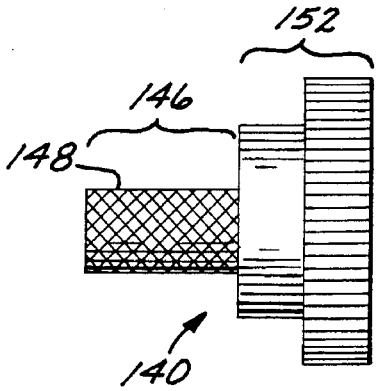
FIG. 7 is an elevational view of the thumb pin.

FIG. 7 illustrates the thumb pin 140 of the present invention in greater detail. The thumb pin 140 is generally cylindrical with two parts. A first portion 146 has a first size and cross sectional shape, and has a length equal to the thickness of the portion of the blade 30 to which it is assembled. The first portion includes a key 148. The key 148 has a shape that is matched to, but before assembly slightly oversize with respect to, the shape of a thumb pin receiver opening 150 in the blade 30. That is, the thumb pin receiver opening 150 acts as a keyway for the receipt of the key 148. In the present case, the key 148 is of a "D" shape, matched to a "D" shape of the thumb pin receiver opening 150. The first portion 146 is roughened, preferably by knurling. To assemble the thumb pin 140 to the blade 30, the key 148 of the first portion 146 is aligned to the thumb pin receiver opening 150. The first portion 146 is force fit into the thumb pin receiver opening 150, slightly compressing the roughened structure of the first portion 146 to fit within the receiver opening. This compressive fit holds the thumb pin 140 tightly in the thumb pin receiver opening 150, and the keying action prevents the thumb pin from rotating during service. No separate fastener is required.

The thumb pin 140 includes a second portion 152 that is radially enlarged over at least a part of its length, to provide a thumb contact surface for the user of the knife. The radially enlarged part of the second portion 152 may be smooth, as shown, or slightly roughened to provide a frictional surface for the user. The thumb pin structure and the detent mechanism previously described cooperate to aid in the reliable retention of the blade at the closed position within the knife and its smooth opening.

The side pieces 24 and 26 are preferably made of a durable plastic such as Zytel$^R$ plastic made by Dupont. Such a material, however, is smooth and can become slippery when wet. To aid in the grasping of the knife 20 by the user, the side pieces 24 and 26 are preferably made of Alcryn$^R$ elastomer made by Dupont. The use of such inserts 160 requires great care in their design and assembly to ensure that they do not loosen and separate from the knife body 22 during service. The inserts are designed to be held in place by a combination of structural constraint and bonding.

FIG. 1 shows an inside surface 162 of the insert 160*a* in the first side piece 24, and an outside surface 164 of the insert 160*b* in the second side piece 26. The inserts 160*a* and 160*b* are identical in structure and mode of attachment to their respective side pieces. In the illustrated embodiment, the inserts 160 are oval, extending most of the length of the central portion of their respective side pieces.

Figure 8:
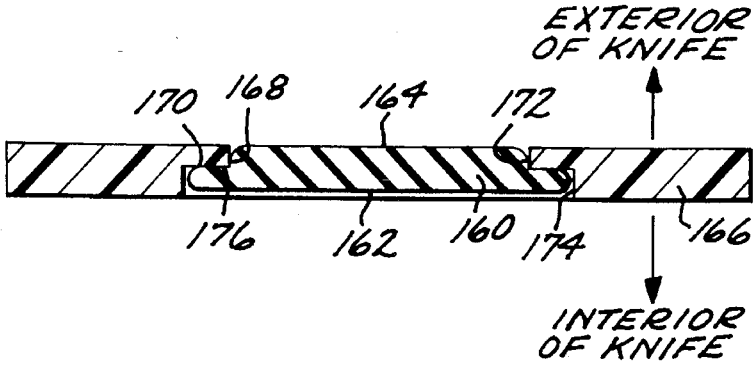
FIG. 8 is a sectional view through one of the side pieces of the knife of FIG. 1, taken along line 8—8 of FIG. 1.

FIG. 8 is a sectional view through one of the side pieces, generically indicated at numeral 166. The side piece 166 has an opening 168 therethrough. The opening 168 includes a stepped inwardly facing shoulder 170 by which the size of the opening is changed through the thickness of the side piece 166. The shoulder 170 is such that the larger part 172 of the opening 168 faces inwardly toward the interior of the knife and the smaller part 174 of the opening faces outwardly toward the exterior of the knife. The elastomeric insert 160 is matched in size to the opening 168 and has a matching stepped outwardly facing shoulder 176. The insert 160 is assembled to the side piece 166 so that the shoulders 170 and 176 are in facing contact. The insert 160 is thereby constrained in place against outwardly movement to the exterior of the knife by the contact of the shoulders 170 and 176. The insert 160 is fixed in place against inward movement by bonding it to the side piece along the shoulders and any other contacting points. The bonding can be accomplished by any operable technique, most preferably sonic welding. An adhesive can also be used, but is less preferred.

The inserts 160 are thus held firmly in place in the sides of the knife, and aid the user in grasping the knife during service.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A knife, comprising:

a knife body having a first side piece and a second side piece, the second side piece being parallel to and separated from the first side piece, the first side piece and the second side piece having aligned pivot axle bores therethrough;

a cylindrical pivot axle extending through the pivot axle bores;

a blade pivotably supported on the pivot axle;

a clip having an engagement region; and keying means for engaging the clip to the first side piece and for preventing the clip from rotating with respect to the first side piece, the keying means including a key on the pivot axle, and a keyway on the clip engagement region.

2. The knife of claim 1, wherein the key comprises a flat surface formed on the pivot axle, and the keyway comprises an engagement opening through the engagement region of the clip and a flat region on an interior bore of the engagement opening, the flat region of the keyway being disposed and dimensioned to engage the flat surface of the key.

3. The knife of claim 1, wherein the engagement region of the clip has a noncircular periphery, and wherein the means for engaging further includes a recess in the first sidepiece, the recess having a periphery shaped to engagably receive therein the noncircular periphery of the engagement region of the sidepiece.

4. The knife of claim 1, wherein the means for engaging further includes engagement threads in one end of the pivot axle a cap having a region threaded for engagement to the engagement threads, the cap having a head larger in size than the cylindrical diameter of the pivot axle.

5. A knife, comprising:

a blade having a top side and a bottom side;

a first side piece;

a second side piece lying parallel to, and spaced apart from, the first side piece, the side pieces each having a top side and a bottom side that respectively lie adjacent to the top side and the bottom side of the blade when the blade is in an open position;

a pivot axle extending between the first side piece and the second side piece at a first end of the knife, the blade being supported on the pivot axle so that the blade may pivot from the open position to a closed position;

a locking plate lying parallel to and between the first side piece and the second side piece, the locking plate being positioned between the first side piece and the blade when the blade is in the closed position, the locking plate having a first end adjacent to the pivot axle and a second end remote from the pivot axle;

the first side piece having a raised first rim along the bottom side of the side piece adjacent to the second end of the locking plate, and the second side piece having a raised second rim along the top side of the side piece adjacent to the second end of the locking plate, the first rim and the second rim capturing the second end of the locking plate therebetween.

6. The knife of claim 5, wherein the locking plate includes a first bore therethrough positioned and dimensioned so that the pivot axle passes therethrough.

7. The knife of claim 5, wherein the knife further includes a rear bore through the first side piece, the second side piece, and the second end of the locking plate, and a rear fastener set extending through the rear bore to fasten the first side piece, the second side piece, and the second end of the locking plate together.

8. The knife of claim 5, further including a front fastener head engaged to the pivot axle to lock together the first side piece, the second piece, the first end of the locking plate, and the blade.

* * * * *